US006908498B2

(12) United States Patent
Ament et al.

(10) Patent No.: US 6,908,498 B2
(45) Date of Patent: Jun. 21, 2005

(54) CARBON-CONCENTRATED MICROWAVE REGENERATED DIESEL PARTICULATE TRAP

(75) Inventors: Frank Ament, Troy, MI (US); Eugene V. Gonze, Pinckney, MI (US)

(73) Assignee: General Motors Corporation, Detroit, MI (US)

( * ) Notice: Subject to any disclaimer, the term of this patent is extended or adjusted under 35 U.S.C. 154(b) by 61 days.

(21) Appl. No.: 10/304,897

(22) Filed: Nov. 26, 2002

(65) Prior Publication Data

US 2004/0099139 A1 May 27, 2004

(51) Int. Cl.[7] ..... B01D 46/00

(52) U.S. Cl. ..... 95/278; 95/14; 95/273; 55/282.3; 55/385.3; 55/523; 55/DIG. 10; 55/DIG. 30; 60/311

(58) Field of Search ..... 95/14, 273, 278; 55/385.3, 282.3, 523, DIG. 10, DIG. 30; 60/311

(56) References Cited

U.S. PATENT DOCUMENTS

| | | | | |
|---|---|---|---|---|
| 5,087,272 A | * | 2/1992 | Nixdorf | 55/DIG. 30 |
| 5,194,078 A | * | 3/1993 | Yonemura et al. | 55/DIG. 30 |
| 6,712,884 B2 | * | 3/2004 | Bruck et al. | 55/282.3 |
| 2001/0017026 A1 | * | 8/2001 | Peters et al. | 55/282.3 |

FOREIGN PATENT DOCUMENTS

| | | | | |
|---|---|---|---|---|
| WO | WO 02/00326 A2 | * | 1/2002 | B01D/45/00 |

* cited by examiner

*Primary Examiner*—Duane Smith
*Assistant Examiner*—Jason M. Greene
(74) *Attorney, Agent, or Firm*—Christopher DeVries

(57) ABSTRACT

A method and apparatus for initiating regeneration in a particulate trap including the steps of locating structures in the particulate trap in areas that generate particulate build up, generating microwaves, absorbing microwaves with the particulate build up, and controlling the microwaves to initiate a burn off of particulates.

10 Claims, 3 Drawing Sheets

CARBON-CONCENTRATED MICROWAVE REGENERATED DIESEL PARTICULATE TRAP

TECHNICAL FIELD

The present invention relates to a diesel particulate trap. More specifically, the present invention relates to a method and apparatus for regenerating a diesel particulate trap using microwave radiation.

BACKGROUND OF THE INVENTION

Increased regulation has reduced the allowable levels of particulates generated by diesel engines. The particulates can generally be characterized as a soot that is captured and reduced by particulate filters or traps. Present particulate filters or traps contain a separation medium with tiny pores that capture particles. As trapped material accumulates in the particulate trap, resistance to flow in the particulate trap increases, generating backpressure. The particulate trap must then be regenerated to burn off the particulates/soot in the particulate trap to eliminate the backpressure and allow air flow through the particulate trap. Past practices of regenerating a particulate trap utilized an energy source such as a burner or electric heater to generate combustion in the particulates. Particulate combustion in a diesel particulate trap by these past practices has been found to be difficult to control and may result in an excessive temperature rise.

SUMMARY OF THE INVENTION

The present invention is a method and apparatus for regenerating a particulate trap using microwave energy. The present invention in the preferred embodiment uses concentrated particulate matter ignited by microwave radiation to initiate the burn off of particles/soot in a particulate trap. The particulates are concentrated in desired areas in the particulate trap using structures such as tabs or walls.

The present invention includes a particulate trap placed in the exhaust flow of a diesel engine. A microwave source may be operatively coupled to a wave guide, and a focus ring may be used to direct the microwaves to particulate matter or microwave absorbing materials. The concentrated particulate matter or microwave-absorbing material generates heat in response to incident microwaves to burn off particulates. Materials transparent to microwaves are preferably used for the basic construction of the particulate trap housing and other areas in the particulate trap where it would be inefficient to absorb microwave energy. By strategically locating structures to accumulate particulate matter and/or microwave absorbing materials, microwaves may be used efficiently at the locations they are most needed to initiate the burn off of particulates and heat catalyst materials.

DESCRIPTION OF THE PREFERRED EMBODIMENT

Figure 1:
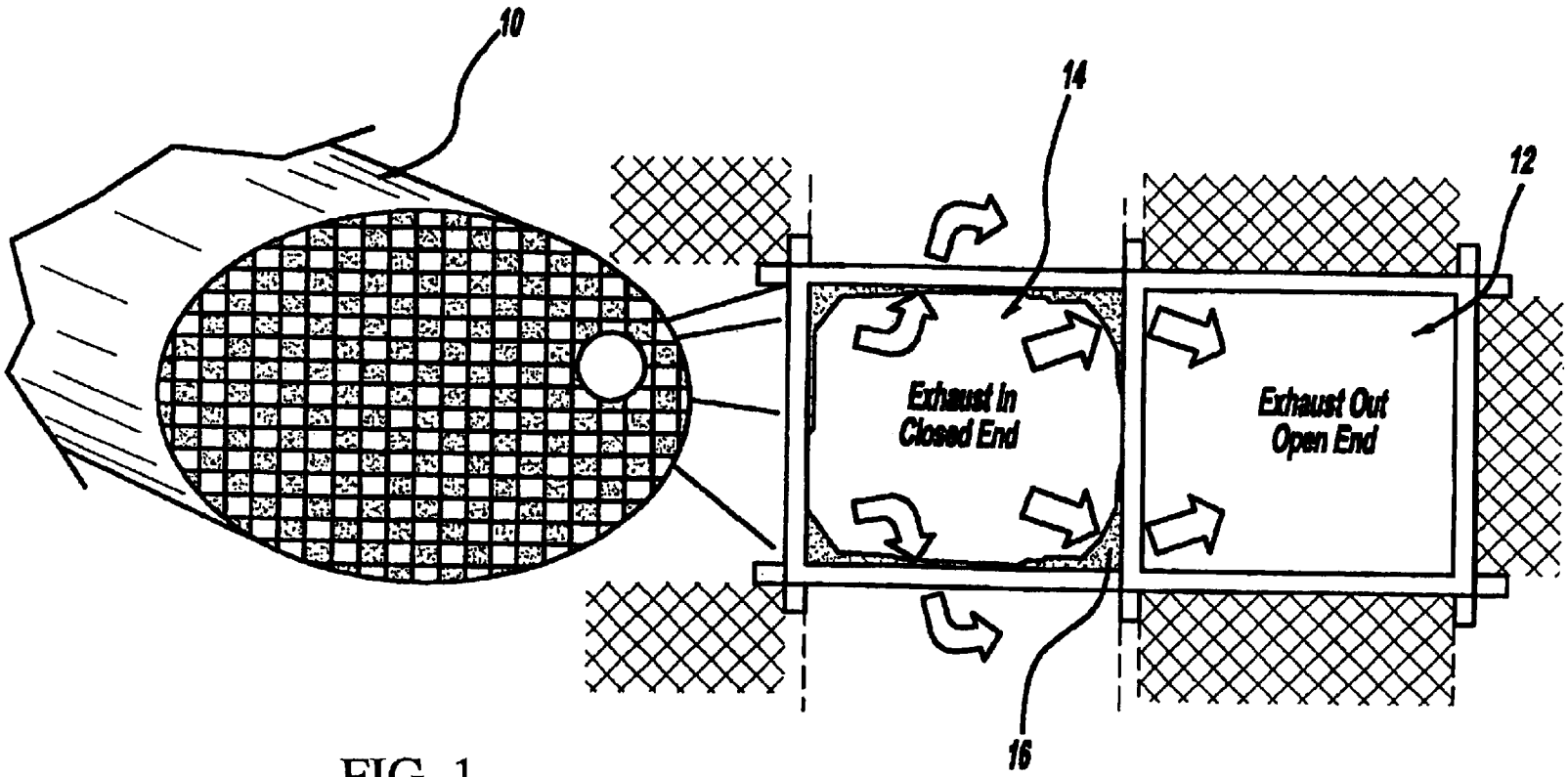
FIG. 1 is a diagrammatic drawing of a wall flow monolith particulate trap.

FIG. 1 is a diagrammatic drawing of a typical wall flow monolith particulate trap 10 "particulate trap" used in diesel applications. The particulate trap 10 includes alternating closed cells/channels 14 and open cells/channels 12. Exhaust gases such as those generated by a diesel engine enter the closed end channels 14, depositing particulate matter 16 and exiting through the open channels 12. The particulate trap 10 structure is preferably comprised of a porous ceramic honeycomb wall of chordierite material, but any ceramic honeycomb material is considered within the scope of the present invention.

Figure 2:
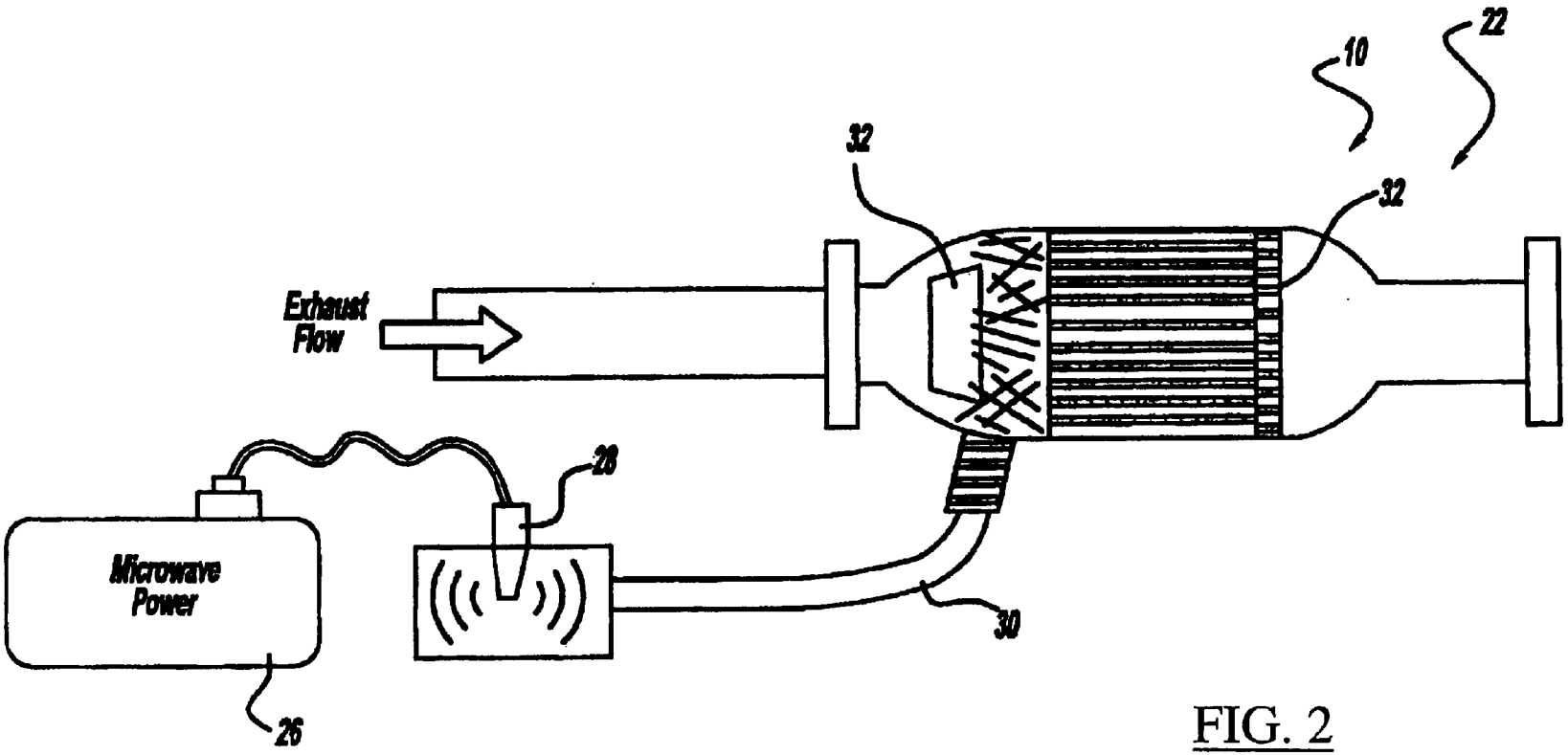
FIG. 2 is a diagrammatic drawing of the microwave regeneration system of the present invention.

FIG. 2 is a diagrammatic drawing of the microwave system 22 of the present invention. The system 22 includes a particulate trap 10 placed in the exhaust flow of a diesel engine. A microwave power source 26 and microwave antenna 28 may be operatively coupled to a wave guide 30, and an optional focus ring 32 to direct the microwaves to the particulate trap 10. In alternate embodiments of the present invention, the microwave antenna 28 is directly coupled to the housing of the particulate trap 10.

Concentrated particulate deposits generate heat in response to incident microwaves to initiate the burn off of particulates in the particulate trap 10. Materials such as chordierite that are transparent to microwaves are preferably used for the basic construction of the particulate trap 10 housing and other areas in the particulate trap 10 where it would be inefficient to absorb microwave energy. As the chordierite does not absorb microwave energy, the microwaves will "bounce" around until they are incident upon the particulate deposits. The temperature of the particulate trap 10 may be regulated by the timed build up of particulates and by controlling the application of the microwave energy. A metallic honeycomb 32 may be fitted to the particulate trap 10 to block microwaves exiting the particulate trap 10.

Figure 3:
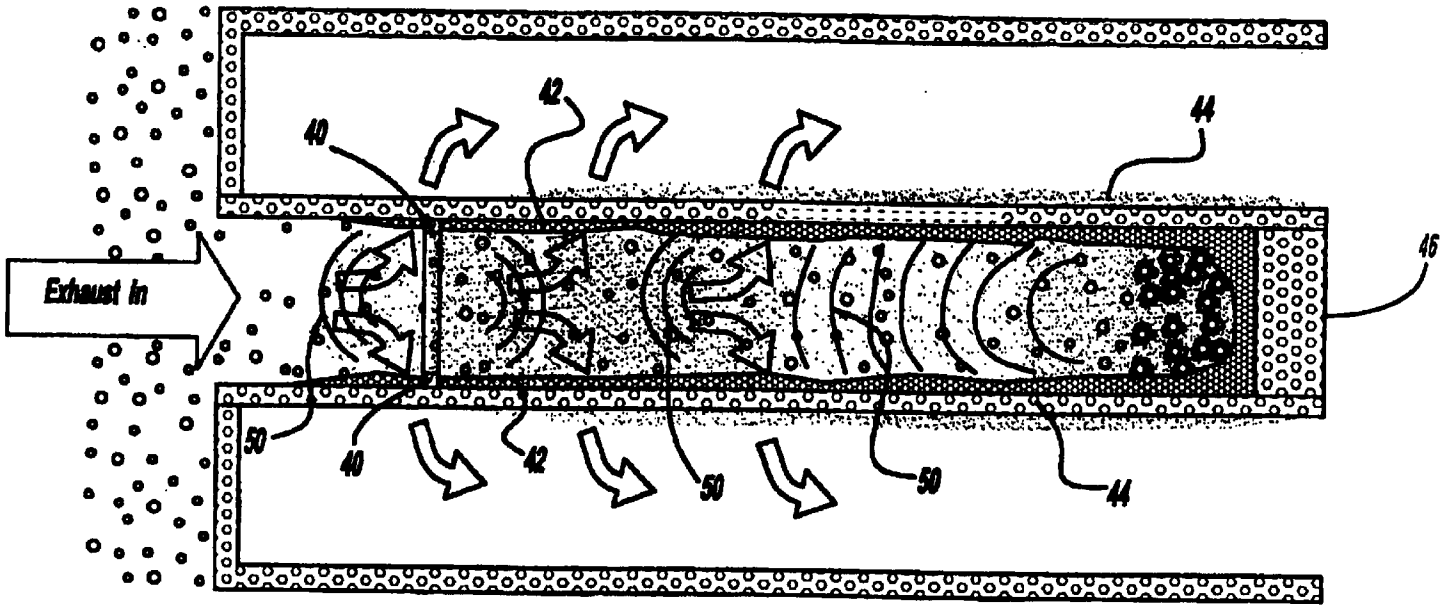
FIG. 3 is a diagrammatic drawing illustrating a particulate trap of the present invention.

FIG. 3 is a diagrammatic drawing of a particulate trap configured with structures 40 to collect particulate matter. The structures 40 will accumulate matter in preferred locations in the particulate trap 10. Diesel exhaust filled with particulates flows through the particulate trap, depositing particulates 42 upon walls 44 of the particulate trap 10 with concentrations of particulate matter occurring around the structures 40 and end plug 46. The microwave field density will inherently focus on the most microwave absorbent materials. In the present invention, the most absorbent materials in the particulate trap 10 are the particulate concentrations around the mid-channel structures 40 and the end plug 46. The particulate concentrations create a hot spot or ignition point for the microwave energy that burns off particulates deposited on the walls 44 of the particulate trap 10. Microwaves incident upon particulate deposits initiate the burn off of the particulates 42 to clear the walls 44 of the particulate trap 10, as seen by waves 50 that represent the flame front of the particulate burn off. The ignition of a relatively small amount of particulates, that are ignited by the particulate concentrations, will be leveraged to burn a relatively large amount of particulates. The present invention is self regulating in temperature, as energy absorption by the deposits of particulate matter will stop as the particulates combust. Accordingly, the microwave energy will be absorbed by the next largest carbon deposit within the particulate filter. This pattern of microwave absorption and particulate combustion uniformly initiates the regeneration process within the particulate filter.

Figure 4:
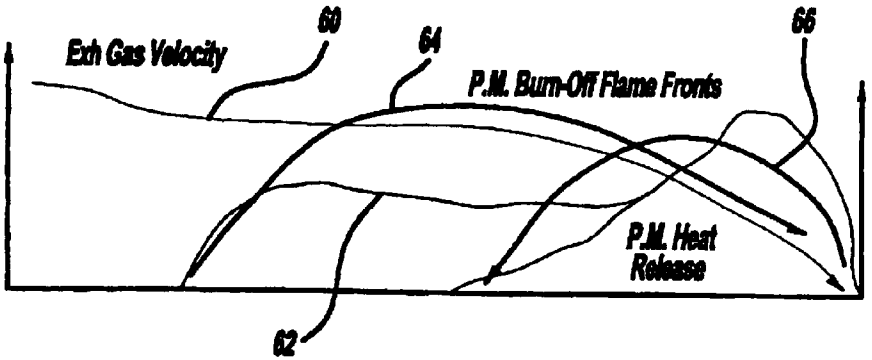
FIG. 4 is a plot detailing the exhaust gas velocity, flame front, and heat release generated by the end plug heating illustrated in FIG. 3.

FIG. 4 illustrates the performance of the particulate trap shown in FIG. 3. The exhaust gas velocity shown as plot 60 will decrease as a function of the distance of the closed end channel. The heat shown as plot 62 generated by the particulate heat release will initially be localized mid-channel and near the end plug 46, and then propagate as a burn-off flame front shown by arrows 64 and 66.

The preferred structures 40 used to generate the build up of particulate matter have been show as walls in the present invention, but any structure that may generate a concentration of particulate matter in a particulate trap is considered within the scope of the present invention. The structures include, but are not limited walls, tabs, points, arrays of prominences, and other similar structures.

It is to be understood that the invention is not limited to the exact construction illustrated and described above, but that various changes and modifications may be made without departing from the spirit and scope of the invention as defined in the following claims.

What is claimed is:

1. A particulate filter for an internal combustion engine comprising:

a microwave source generating microwaves;

at least one structure located on a wall in the particulate filter to generate a concentration of particulate matter in the particulate filter that are ignited by said microwaves; and wherein said at least one structure is a depression in the wall of said particulate filter.

2. A particulate filter for an internal combustion engine comprising:

a microwave source generating microwaves;

at least one structure located on a wall in the particulate filter to generate a concentration of particulate matter in the particulate filter that are ignited by said microwaves; and wherein said structure is located offset from an end plug of said particulate filter.

3. The particulate filter of claim 1 wherein said particulate trap is comprised of a microwave transparent material.

4. The particulate filter of claim 3 wherein said microwave transparent material is chordierite.

5. A method of regenerating a particulate trap comprising:

generating microwave radiation;

providing a structure configured as a depression in the wall of said particulate trap to generate a deposition of particulate matter; and absorbing microwaves to generate heat to burn particulates in the particulate trap.

6. The method of claim 5 further comprising the step of initiating a flame front by igniting the deposition of particulate matter.

7. The method of claim 5 further comprising the step of controlling the temperature of the particulate trap by controlling the microwave radiation.

8. The method of claim 5 further comprising measuring the temperature of the particulate trap.

9. A system for removing particulates in a particulate trap comprising:

a microwave power source;

a microwave antenna coupled to said power source for generating microwaves;

structures configured as depressions in said particulate trap, wherein said structures create a deposition of particulate matter, said deposition of particulate matter ignited by said microwaves to generate heat to burn off particulates located in said particulate trap.

10. The system of claim 9 further comprising a diesel engine coupled to said particulate trap, wherein diesel exhaust propagates through said particulate trap.

* * * * *